US006368134B2

(12) United States Patent
Richter

(10) Patent No.: US 6,368,134 B2
(45) Date of Patent: Apr. 9, 2002

(54) ELECTRICAL CONNECTOR WITH LOOSENING-PREVENTION RING

(75) Inventor: Michael Richter, Schalksmühle (DE)

(73) Assignee: Karl Lumberg GmbH & Co., Schalksmuhle (DE)

( * ) Notice: Subject to any disclaimer, the term of this patent is extended or adjusted under 35 U.S.C. 154(b) by 0 days.

(21) Appl. No.: 09/792,288

(22) Filed: Feb. 23, 2001

(30) Foreign Application Priority Data

Feb. 23, 2000 (DE) ..... 100 08 252

(51) Int. Cl.[7] ..... H01R 4/38; H01R 13/62
(52) U.S. Cl. ..... 439/321; 439/312
(58) Field of Search ..... 439/320, 321, 439/322, 312

(56) References Cited

U.S. PATENT DOCUMENTS 2,986,720 A * 5/1961 Chess ..... 439/322
3,150,231 A * 9/1964 Clark ..... 439/321
4,066,314 A * 1/1978 Williams ..... 439/312
4,355,854 A * 10/1982 Williams ..... 439/312
4,585,289 A * 4/1986 Bocher ..... 439/312
5,366,383 A * 11/1994 Dearman ..... 439/321
5,376,015 A * 12/1994 Fuchs et al. ..... 439/312
5,681,177 A * 10/1997 Mikolaicyk et al. ..... 439/321
5,971,787 A * 10/1999 Brown ..... 439/321
6,086,400 A * 7/2000 Fowler ..... 439/321

* cited by examiner

*Primary Examiner*—Brian Sircus
*Assistant Examiner*—Hae Moon Hyeon
(74) *Attorney, Agent, or Firm*—Herbert Dubno; Andrew Wilford

(57) ABSTRACT

An electrical connector has an insulating body centered on an axis, carrying at least one conductor, and having a radially outwardly directed tooth having a radially outwardly directed outer surface with an apex spaced at a predetermined radial distance from the axis. A nut rotatable about the axis on the body bears axially forward on the body and has a radially directed tooth axially level with the body tooth and having a radially inwardly directed inner surface with an apex forming on rotation of the nut about-the body an orbit having a radius from the axis greater by a predetermined spacing than the predetermined radial distance of the body-tooth outer-surface apex. A radially compressible ring surrounding the body overlies the tooth outer surface. The ring has a cross-sectional diameter equal to more than the predetermined spacing between the nut tooth and the body tooth so that for the nut tooth to angularly pass the body tooth it must compress the ring to the predetermined spacing.

10 Claims, 2 Drawing Sheets

ELECTRICAL CONNECTOR WITH LOOSENING-PREVENTION RING

FIELD OF THE INVENTION

The present invention relates to an electrical plug. More particularly this invention concerns such a plug adapted to be secured by a retaining collar to another plug or socket.

BACKGROUND OF THE INVENTION

An electrical connector assembly as defined in U.S. Pat. No. 5,376,015 and used for a proximity switch has a threaded part having a conductor, an unthreaded part having a conductor, fittable along an axis with the threaded part for engagement of the conductors with each other, and formed with front and back axially spaced stops, and an internally threaded nut axially displaceable on the unthreaded part between the stops through a predetermined axial distance, rotatable about the axis on the unthreaded part, and threadedly engageable with the threaded part to lock the parts axially together with the nut engaging the front stop. The nut is formed with at least one axially extending and radially projecting tooth, the unthreaded part is formed with at least one axially extending and radially projecting tooth, and the teeth are so positioned that they come into engagement with each other only during a small fraction of the displacement of the nut on the unthreaded part immediately prior to engagement with the front stop.

Thus with this system in the last stages of securing the two parts together, as the nut is given its last turn or two, the teeth engage each other and increase the resistance to relative rotation between the nut and the threaded part. When the parts are initially threaded together and during the initial stages of screwing down the nut, the teeth are not in radial engagement with each other and may not even be in angular engagement with each other. Once they are engaged with each other, any force tending to unscrew the nut will have to make the teeth pass each other. Thus such a connector assembly is unlikely to open up as the result of vibration causing the nut to unscrew, since in the initial stages of such unscrewing the teeth must be deformed to allow the two parts to rotate relative to each other.

The disadvantage of this system is that, with time, the teeth wear. They can eventually become so worn down that they scarcely touch, offering no significant resistance to unscrewing of the nut.

OBJECTS OF THE INVENTION

It is therefore an object of the present invention to provide an improved electrical plug.

Another object is the provision of such an improved electrical plug which overcomes the above-given disadvantages, that is which will have a long service life so as, even when quite old, to effectively resist unscrewing.

SUMMARY OF THE INVENTION

An electrical connector has according to the invention an insulating body centered on an axis, carrying at least one conductor, and having a radially outwardly directed tooth having a radially outwardly directed outer surface with an apex spaced at a predetermined radial distance from the axis. A nut rotatable about the axis on the body bears axially forward on the body and has a radially directed tooth axially level with the body tooth and having a radially inwardly directed inner surface with an apex forming on rotation of the nut about the body an orbit having a radius from the axis greater by a predetermined spacing than the predetermined radial distance of the body-tooth outer-surface apex. A radially compressible ring surrounding the body overlies the tooth outer surface. The ring has a cross-sectional diameter equal to more than the predetermined spacing between the nut tooth and the body tooth so that for the nut tooth to angularly pass the body tooth it must compress the ring to the predetermined spacing.

Thus with this system actual engagement of the teeth with each other is avoided; instead they compress the ring that comes between them. This ring can be made of a highly durable and compressible material so that it will have a long service life. Even if it wears out, it can be replaced easily. It is normally an O-ring.

According to the invention offset from the inner-tooth outer-surface apex the nut has a radial dimension which is generally equal to the radial distance of the body-tooth outer-surface apex plus the cross-sectional diameter of the ring. Thus except when the teeth are angularly passing each other, the ring is substantially uncompressed.

The body according to the invention is formed with a groove receiving the ring and having a floor from which the body tooth projects. In addition the body is formed with a plurality of the body teeth angularly equispaced about the axis and the nut is also formed with a plurality of the nut angularly equispaced about the axis. The nut teeth are more numerous than the body teeth, normally twice as many. There are at least three body teeth and the body is of round-cornered polygonal section at the body teeth. In a particularly advantageous system giving eight stable positions for the nut there are four body teeth and the body is of generally square section at the body teeth.

The nut has a radially inwardly directed rim formed with the nut tooth and the body has a radially outwardly directed annular ridge against which the rim can bear axially forward. More particularly the body has a pair of axially confronting stop faces between which the rim is captured and spaced apart by an axial distance equal to substantially more than an axial thickness of the rim. The rim is movable between a forward position with the teeth axially level with each other and the rim bearing on one of the body faces and a rear position with the teeth axially offset from each other and the rim bearing on the other of the body faces.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
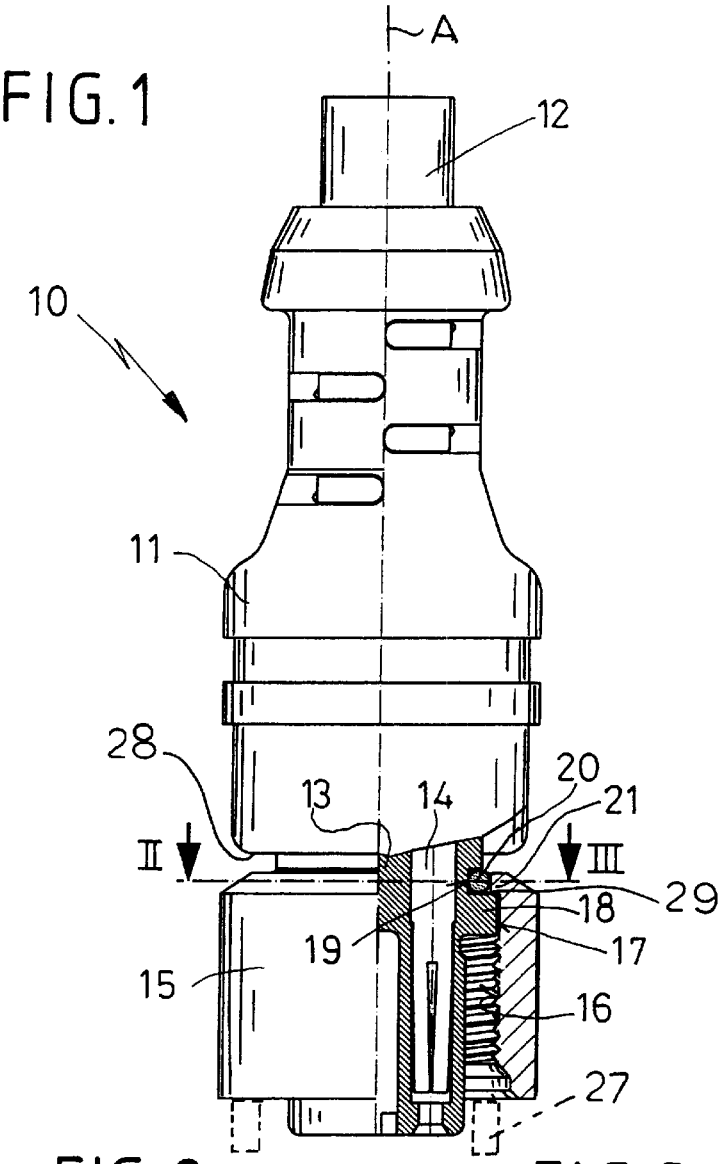
FIG. 1 is a side view partly in axial section of an electrical plug according to the invention.

As seen in FIG, 1 an electrical connector or plug has a plastic body 11 mounted on one end of a multiconductor cable 12 and having an molded plastic end 13 of generally square section and provided with a plurality of metallic conductors 14 of which only one is shown. The plug 10 is centered on an axis A and is fitted axially over another internally generally square connector or socket shown schematically at 27 with each of the conductors 14 mating with an unillustrated conductor of this connector 27.

Rotatable about the axis A on the body 11 is a cylindrical and metallic collar or nut 15 having an internal screwthread 16 adapted to mate with an external screwthread of a cylindrical outer surface of the other connector or socket 27. The body 13 is formed with a radially outwardly projecting ridge 18 having a cylindrical outer surface 17 bearing radially outwardly on an inner surface of the nut 15 and centering the nut 15 on the axis A. The nut 15 has at its rear end a radially inwardly projecting annular rim 21 that can bear axially forward (down in FIG. 1) on a back stop face 29 of the ridge 18. The body 11 of the connector has a circularly annular and planar front stop face 28 spaced back from the back face 29 of the ridge 18 by a distance equal to about twice the axial dimension of the rim 21.

Figure 4:
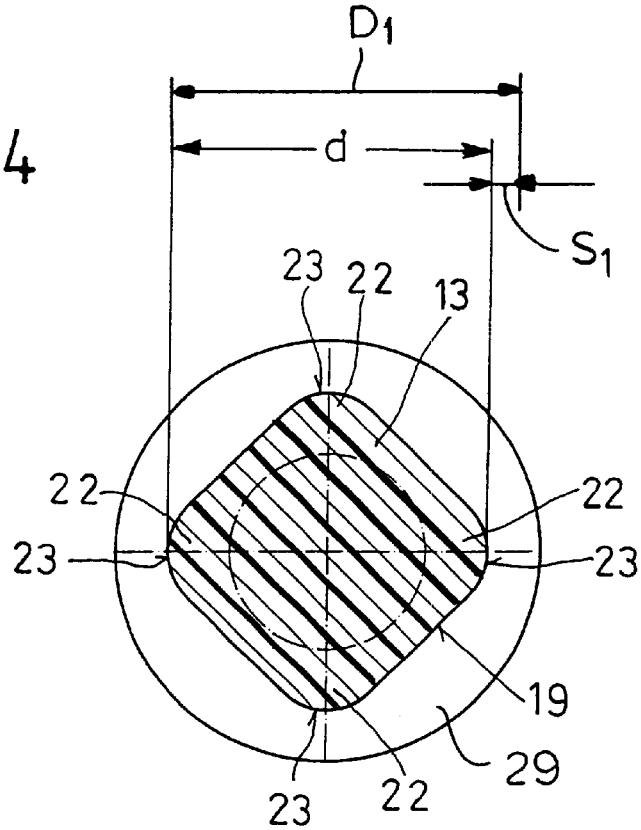
FIGS. 4 and 5 are views of respective details of FIG. 2.

According to the invention the groove 19 has as illustrated in FIG. 4 a floor that is formed with four angularly equispaced rounded teeth 22 each having an outer surface 23, imparting to the end 13 a rounded-corner square section at the groove 19. The maximum diameter d of the end 13 measured at the floor of the groove 19 therefore extends from the apex of one tooth 22 diametrally to that of the opposite tooth 22.

Figure 5:
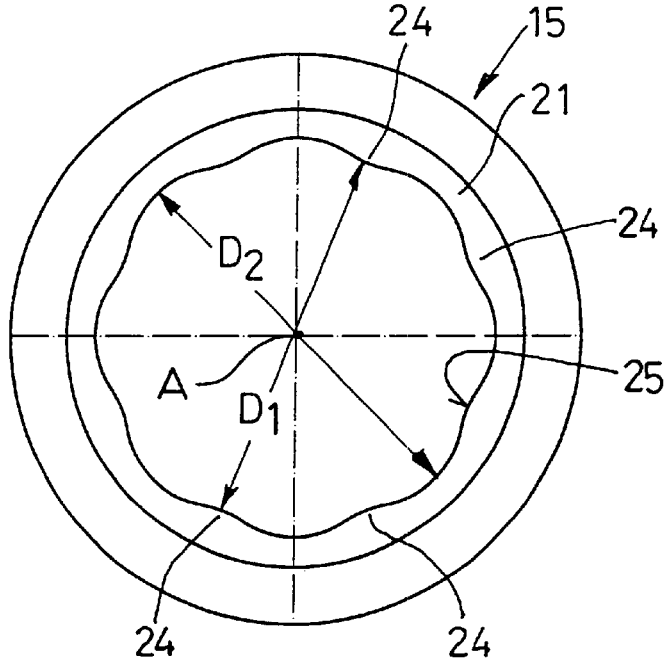

Similarly as shown in FIG. 5 the ridge 21 has an inner edge formed with eight angularly spaced and inwardly directed rounded teeth or bumps 24 having inner surfaces 25 radially confronting the surfaces 23. The rim 21 has an inner diameter measured from the apexes of the teeth 24 of $D_1$ and a slightly larger diameter $D_2$ measured at the troughs between the teeth 24.

In accordance with the invention the diameter d of the groove 1 at its greatest is smaller by a distance $S_1$ than the smaller inner diameter $D_1$ and an O-ring 20 is received in the groove 19 between the surfaces 23 and 25. This O-ring 20 has a normal diameter 26 when substantially uncompressed which is greater than the distance $S_1$ and in fact equal to a difference $S_2$ between the diameters d and $D_2$.

Figure 2:
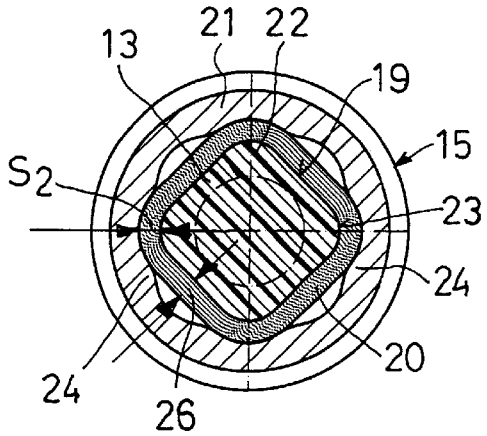
FIG. 2 is a section taken along line II–III of FIG. 1.
Figure 3:
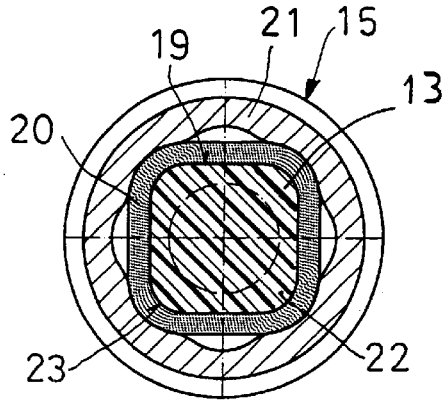
FIG. 3 is a section like FIG. 2 but in another relative angular position.

Thus as shown in FIGS. 2 and 3 when the teeth 22 are aligned between the teeth 24, the O-ring 20 will be substantially uncompressed. To move the nut 15 rotationally from the position of FIG. 2 to the position of FIG. 3, it is necessary to momentarily compress the O-ring at four points from its natural diameter $S_2$ to a much smaller radial dimension $S_1$. This compression clearly takes some work so rotating the nut 15 on the body 11 will be somewhat difficult, and will prevent the nut 15 from unscrewing when vibrated.

In this embodiment the nut 5 can even be pulled somewhat axially back from the O-ring 20, by pulling the rim 21 off the back stop face 29 of the ridge 18 and butting it backward against the stop face 28 of the body 11. In this retracted position of the nut 15 it will rotate very freely. Only when in the advanced position at the end of the tightening operation will the rim 21 be pulled forward where its rotation is impeded by the O-ring 20.

I claim:

1. An electrical connector comprising:

an insulating body centered on an axis, carrying at least one conductor, and having a radially outwardly directed tooth having a radially outwardly directed outer surface with an apex spaced at a predetermined radial distance from the axis;

a nut rotatable about the axis on the body, bearing axially forward on the body, and having a radially directed tooth axially level with the body tooth and having a radially inwardly directed inner surface with an apex &paced from the axis by a radius greater by a predetermined spacing than the predetermined radial distance of the body-tooth outer-surface apex; and a radially compressible ring surrounding the body and overlying the body-tooth outer surface, the ring having a cross-sectional diameter greater than the predetermined spacing, whereby for the nut tooth to angularly pass the body tooth it must compress the ring to the predetermined spacing, the nut having angularly offset from the nut-tooth outer-surface apex a radius generally equal to the radial distance of the body-tooth outer-surface apex from the axis plus the cross-sectional diameter of the ring.

2. The electrical connector defined in claim 1 wherein the ring is an elastomeric O-ring.

3. The electrical connector defined in claim 1 wherein the body is formed with a groove receiving the ring and having a floor from which the body tooth projects.

4. The electrical connector defined in claim 1 wherein the body is formed with a plurality of the body teeth angularly equispaced about the axis and the nut is also formed with a plurality of the nut teeth angularly equispaced about the axis.

5. The electrical connector defined in claim 4 wherein the nut teeth are more numerous than the body teeth.

6. The electrical connector defined in claim 4 wherein there are twice as many nut teeth as body teeth.

7. An electrical connector comprising:

an insulating body centered on an axis, carrying at least one conductor, and having at least three radially outwardly directed teeth angularly equispaced about the axis and each having a radially outwardly directed outer surface with an apex spaced at a predetermined radial distance from the axis, the body being of round-cornered polygonal section at the body teeth;

a nut rotatable about the axis on the body, bearing axially forward on the body, and having a plurality radially directed and angularly equispaced teeth axially level with the body teeth and each having a radially inwardly directed inner surface with an apex spaced from the axis by a radius greater by a predetermined spacing than the predetermined radial distance; and a radially compressible ring surrounding the body and overlying the tooth outer surface, the ring having a cross-sectional diameter greater than the predetermined spacing between the nut tooth and the body tooth, whereby for the nut tooth to angularly pass the body tooth it must compress the ring to the predetermined spacing.

8. The electrical connector defined in claim 7 wherein there are four body teeth and the body is of generally square section at the body teeth.

9. An electrical connector comprising:

an insulating body centered on an axis, carrying at least one conductor, having a radially outwardly directed annular ridge, and having a radially outwardly directed tooth having a radially outwardly directed outer surface with an apex spaced at a predetermined radial distance from the axis;

a nut rotatable about the axis on the body, bearing axially forward on the body, and having a radially inwardly directed rim against which the ridge can engage axially forwardly and formed with a radially inwardly directed tooth axially level with the body tooth and having a radially inwardly directed inner surface with an apex spaced from the axis by a radius greater by a predetermined spacing than the predetermined radial distance of the body-tooth outer-surface apex; and a radially compressible ring surrounding the body and overlying the body-tooth outer surface, the ring having a cross-sectional diameter greater than the predetermined spacing, whereby for the nut tooth to angularly pass the body tooth it must compress the ring to the predetermined spacing the nut has a radially inwardly directed rim formed with the nut tooth and the body has a radially outwardly directed annular ridge against which the rim can bear axially forward.

10. The electrical connector defined in claim 9 wherein the body has a pair of axially confronting faces between which the rim is captured and spaced apart by an axial distance equal to substantially more than an axial thickness of the rim, the rim being movable between a forward position with the teeth axially level with each other and the rim bearing on one of the body faces and a rear position with the teeth axially offset from each other and the rim bearing on the other of the body faces.

* * * * *